United States Patent [19]

Knapp et al.

[11] 4,145,063

[45] Mar. 20, 1979

[54] SKI BOOT SCRAPER

[76] Inventors: Gregory T. Knapp, 833 Videll St., San Lorenzo, Calif. 94580; Gordon Haney, 111 W. Bastanchury Rd., Fullerton, Calif. 92635

[21] Appl. No.: 842,744

[22] Filed: Oct. 17, 1977

[51] Int. Cl.[2] ..... A63C 11/18

[52] U.S. Cl. ..... 280/11.37 E; 15/237

[58] Field of Search ..... 280/11.37 E, 11.37 R; 15/237, 257.2; 135/DIG. 9, 65

[56] References Cited

U.S. PATENT DOCUMENTS

| | | | |
|---|---|---|---|
| 3,018,502 | 1/1962 | Lossius | 15/257.2 |
| 3,310,826 | 3/1967 | Ellis | 15/237 |
| 3,350,111 | 10/1967 | Sahlein et al. | 280/11.37 E |
| 3,929,345 | 12/1975 | Nasby et al. | 280/11.37 E |

FOREIGN PATENT DOCUMENTS

| | | | |
|---|---|---|---|
| 2355748 | 5/1975 | Fed. Rep. of Germany | 280/11.37 E |
| 2601348 | 7/1977 | Fed. Rep. of Germany | 280/11.37 E |

*Primary Examiner*—David M. Mitchell
*Attorney, Agent, or Firm*—William R. Piper

[57] ABSTRACT

A ski boot scraper which is light in weight and is removably attachable to a ski pole and will not interfere with the normal use of the ski pole. The boot scraper is a little more semi-cylindrical shaped in cross section and will yieldingly contact with the ski pole to hold it in place. An anchor block is permanently secured to the ski pole adjacent to the handle and it has an annular groove for removably receiving the lip of the boot scraper for holding the scraper against any longitudinal movement along the ski pole. The lip on the scraper is positioned at one end thereof while the other end of the scraper is tapered to form an integral handle by means of which the scraper can be removed from or applied to the ski pole. One longitudinal edge of the scraper is notched to aid in removing snow from a boot.

2 Claims, 5 Drawing Figures

SKI BOOT SCRAPER

SUMMARY OF THE INVENTION

An object of our invention is to provide a ski boot scraper that can be made of molded plastic. It is an elongated semi-tubular member with an integral outwardly curved lip at one end, a tapered handle portion at the other end. Both elongated edges of the scraper can be used for scraping snow from the ski boots. The semi-circular cross sectional shape of the scraper has an inner diameter slightly less than the outer diameter of the ski pole so that when the scraper is attached to the ski pole, the resilient sides of the scraper will yieldingly grasp the adjacent surface of the pole to hold the scraper in place.

A further object of our invention is to provide a two piece anchor block for the ski boot scraper which is permanently attached to the ski pole adjacent to the handle and it has an annular groove for receiving the lip of the scraper as it is being secured to the pole. The annular groove in the anchor block permits the scraper to be attached to the pole at any position around the entire circumference of the pole. The purpose of the anchor block is to prevent any longitudinal movement of the scraper along the ski pole when the scraper is once secured to the anchor block and pole.

DESCRIPTION OF THE PREFERRED EMBODIMENT

Figures 1, 2, 3, 4, 5:
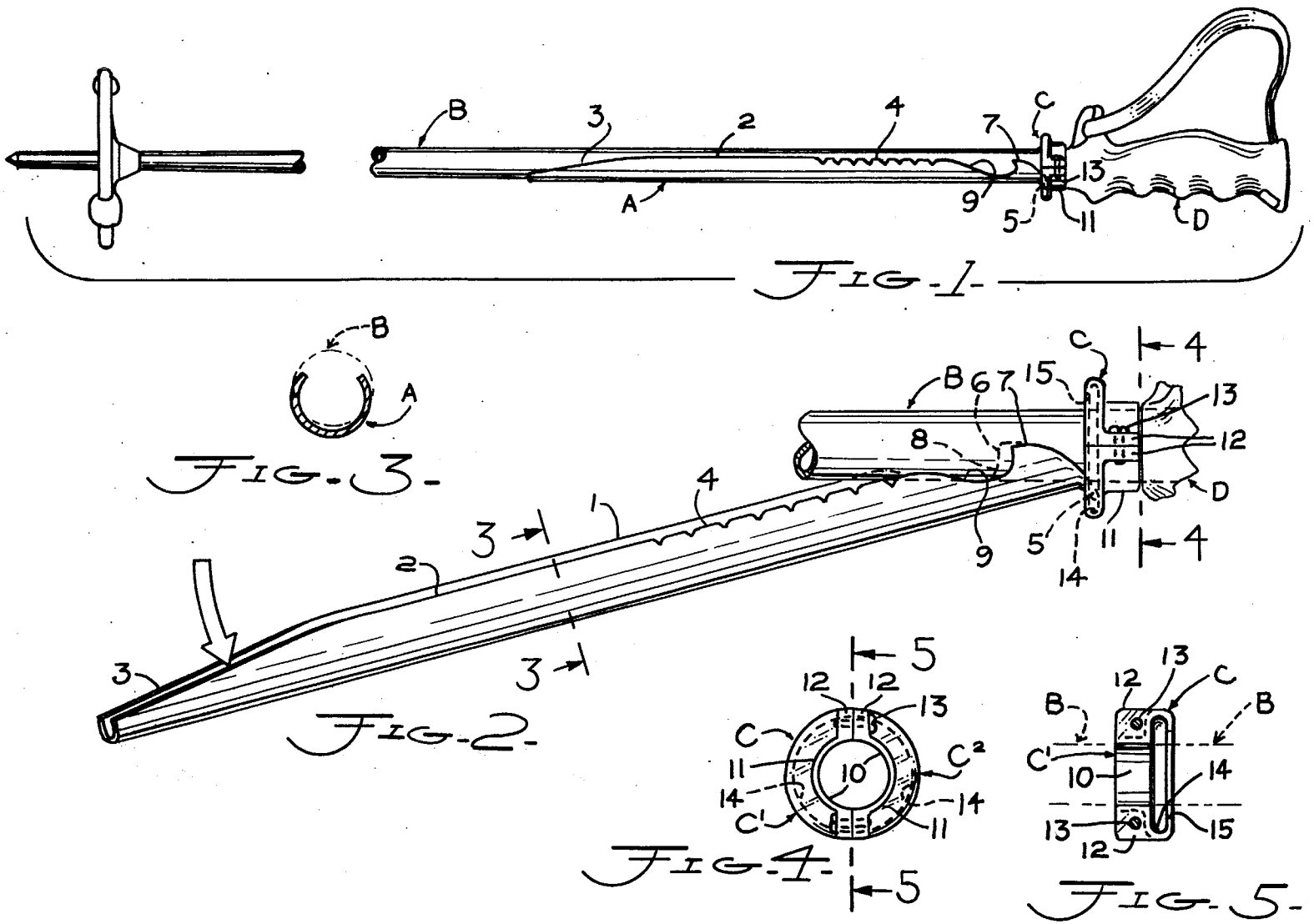
FIG. 1 shows a side elevation of a ski pole with our ski boot scraper removably connected to the pole and to the anchor block to prevent the scraper from sliding along the pole.
FIG. 2 is an enlarged perspective view of the ski boot scraper shown in the act of being swung free from the ski pole and from the anchor block.
FIG. 3 is a transverse section through the ski boot scraper and is taken along the line 3—3 of FIG. 2. The diameter of the ski pole is indicated in FIG. 3 by a dot-dash circle and is superimposed on the sectional view of the ski boot scraper to illustrate that the diameter of the scraper is less than that of the pole so as to produce a clamping action on the pole when the scraper is removably secured thereto.
FIG. 4 is an end view of the anchor block when looking in the direction of the arrows 4—4 in FIG. 2.
FIG. 5 is an interior side elevation of one of the two identical halves making up the complete anchor block and it is taken along the line 5—5 of FIG. 4.

In carrying out our invention we show a perspective view of our ski boot scraper, indicated generally at A, in FIG. 2 The scraper has a semi-cylindrical elongated body which is extremely light in weight, weighing less than one ounce. The body is preferably made of plastic and its inner diameter is slightly less than the outer diameter of the ski pole to which it can be removably secured. The two elongated edges 1 and 2 will yieldingly grip the outer cylindrical surface of the ski pole B, shown in FIG. 1 and by dot-dash lines in FIG. 2. The edges 1 and 2 extend through a little more than half a circle so that they will grip the pole and prevent the accidental removal therefrom.

The scraper body A has a tapered handle portion 3 at one end whose cross section is less than one-half circle, see FIGS. 1 and 2. The handle portion will not yieldingly grip the adjacent cylindrical side of the ski pole and therefore this handle can be manually gripped for pulling the scraper free from the pole. When the scraper is freed, the operator may grip the handle end 3 and use the elongated edge 1 for scraping snow, etc., from his boots or other surface that needs cleaning. The elongated edge 2 has a serrated or toothed portion 4 which the operator may use if the foreign material, such as snow, has hardened and is more difficult to remove.

The end of the scraper A that is opposite from the handle 3, is provided with an outwardly curved lip or projection 5 that has a double function. This lip end 5 of the scraper permits the operator to use it in digging out snow and other foreign material that may have become wedged in a crevice such as formed between the sole and the boot heel. It may also be used to perform many other services. Before setting forth the second function of the lip 5, it is best to mention that the scraper A has two hook shaped portions disposed adjacent to the lip 5. The hook 6 is on the side 1 of the body A while the hook 7 is formed on the side 2, see FIG. 2. Adjacent to the hook 6 there is a recess 8 on the side 1 of the body A and adjacent to the hook 7 there is a recess 9 on the side 2. These two hook-shaped portions 6 and 7 may be used for digging out hard packed snow or other debris on the boot or other surface.

To prevent the scraper A from accidentally slipping along the shank of the ski pole B, we provide a two piece anchor block C which may be permanently attached to the ski pole at a point adjacent to the handle D for the pole, see FIGS. 1, 2, 4 and 5. The anchor block consists of two identical halves $C^1$ and $C^2$. Each half has a half cylindrical recess 10 for receiving the shank of the ski pole B. In addition each half has a half collar 11 with a radially extending lug 12 at each end. The lugs 12 on the two halves $C^1$ and $C^2$, abut each other and grip the shank of the ski pole B, when they are brought together as shown in FIGS. 1 and 2. This will bring the lugs 12 of each half $C^1$ and $C^2$, into abutting relation and the aligned threaded openings in the lugs receive screws 13 which bind the two halves together and secure the anchor block C to the pole adjacent to the handle.

The purpose of the anchor block C, is to receive the lip 5 of scraper A and to prevent the accidental sliding of the scraper along the shank of the ski pole. To this end, we show each identical half $C^1$ and $C^2$, provided with a half annular groove 14 that will form a full 360° annular groove in the completed anchor block C when the two halves are secured together. In addition the annular groove 14 not only communicates with the opening 10 formed by the two interconnected halves $C^1$ and $C^2$, but it also communicates with an opening 15 that is larger in diameter than the outer diameter of the ski pole shank. Therefore, the annular space between the pole shank and the rim of the opening 15 is large enough to receive the thickness of the scraper lip 5 and to permit the operator to first insert the lip into the space provided by the opening 15 when the scraper extends at an angle to the ski pole shank as shown in FIG. 2, and then a swinging of the scraper into parallel relation with respect to the ski pole axis will cause the lip to enter the annular groove 14 and the scraper to yieldingly grip the pole shank. The result is shown in FIG. 1 and FIG. 2 and indicates how the annular edge of the groove 14 will prevent the scraper from being pulled free from the anchor block unless first the handle end 3 is swung away from the pole shank which swinging motion will also free the lip 5 from the groove 14 and permit the entire freeing of the scraper from the ski pole. The scraper A can be attached to the anchor block C, at any point around the entire 360° of the groove 14.

We claim:

1. A ski boot scraper for use with a ski pole and comprising:

a. an elongated body arcuate in cross section with a pair of longitudinally extending edges spaced from each other a distance slightly less than the diameter of the ski pole shank to which the boot scraper is removably secured, the sides of the body yieldingly gripping the shank for preventing the accidental removal of said body from the shank;

b. the two longitudinal edges being usable as snow scrapers when the body is removed from the ski pole shank and one end of said body being tapered to provide a handle portion having an arcuate cross section of less than half a circle;

c. whereby said handle portion will encircle the ski pole shank less than one-half circle and therefore may be more readily grasped for swinging said body free from the shank;

d. an anchor block secured to the ski pole shank adjacent to the ski pole handle and having an annular inner groove facing toward the pole shank with an opening communicating with the groove and having a diameter larger than the pole shank diameter;

e. said ski boot scraper body having an outwardly extending integral lip disposed at the opposite end from said handle portion and having a thickness which permits the lip to enter the anchor block opening when the body is held at an angle to the pole shank and then the lip is inserted into the anchor block opening, the subsequent swinging of the body into yielding engagement with the pole shank causing the lip to enter the anchor block annular groove and to prevent the accidental sliding of the body along the pole shank.

2. The combination as set forth in claim 1: and in which a. the annular groove in said anchor block and the circular opening in the block which communicates with the groove provides a 360° entrance opening around the ski pole shank which will permit the entrance of the boot scraper lip into any portion of the groove that entirely surrounds the shank.

* * * * *